US009739159B2

(12) United States Patent
Carter et al.

(10) Patent No.: US 9,739,159 B2
(45) Date of Patent: Aug. 22, 2017

(54) METHOD AND SYSTEM FOR RELIEVING TURBINE ROTOR BLADE DOVETAIL STRESS

(71) Applicant: General Electric Company, Schenectady, NY (US)

(72) Inventors: Bradley Scott Carter, Simpsonville, SC (US); Michael Anthony Wondrasek, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 816 days.

(21) Appl. No.: 14/049,577

(22) Filed: Oct. 9, 2013

(65) Prior Publication Data

US 2015/0098832 A1 Apr. 9, 2015

(51) Int. Cl.
*F01D 5/30* (2006.01)
*F01D 5/14* (2006.01)

(52) U.S. Cl.
CPC ..... *F01D 5/3007* (2013.01); *F01D 5/147* (2013.01); *F05D 2230/10* (2013.01); *F05D 2260/941* (2013.01); *Y10T 29/49336* (2015.01)

(58) Field of Classification Search
CPC ..... F01D 5/3007
See application file for complete search history.

(56) References Cited

U.S. PATENT DOCUMENTS 4,480,957 A * 11/1984 Patel ..... F01D 5/16 416/219 R
5,141,401 A 8/1992 Juenger et al.
5,435,694 A 7/1995 Kray et al.
6,183,202 B1 2/2001 Ganshaw
6,439,851 B1 8/2002 Wong
6,786,696 B2 * 9/2004 Herman ..... F01D 5/147 416/193 A
7,156,621 B2 * 1/2007 Stone ..... F01D 5/3007 29/407.01
7,513,747 B2 4/2009 Bachofner et al.
7,874,806 B2 1/2011 Phipps
8,257,047 B2 9/2012 Mueller
2003/0049131 A1 * 3/2003 Murakami ..... F01D 5/141 416/241 R
2008/0101939 A1 5/2008 Zemitis et al.
2011/0293429 A1 * 12/2011 Barnett ..... F01D 5/3007 416/219 R
2013/0209253 A1 * 8/2013 Zemitis ..... F01D 5/26 416/1

FOREIGN PATENT DOCUMENTS

JP 6397803 A * 4/1988

* cited by examiner

*Primary Examiner* — Justin Seabe
(74) *Attorney, Agent, or Firm* — Armstrong Teasdale LLP

(57) ABSTRACT

A system for relieving stress on a turbine rotor blade dovetail in a gas turbine is provided. At least one turbine rotor blade includes a dovetail that is axially insertable into a correspondingly-shaped slot defined in a turbine disk. At least one axially-extending tang is defined on the dovetail. At least one stress relief surface is defined in the at least one tang. The at least one stress relief surface extends along a central portion of a length of the tang. Accordingly, contact between the at least one tang and an inner surface of the slot is precluded, along the central portion, such that stresses generated by radially-directed forces along the central portion are reduced.

20 Claims, 6 Drawing Sheets

METHOD AND SYSTEM FOR RELIEVING TURBINE ROTOR BLADE DOVETAIL STRESS

BACKGROUND

This disclosure relates generally to turbines, and, more specifically, to systems and methods for stress relief in dovetails for axial-mounted turbine rotor blades.

Blades (also sometimes referred to as "buckets") for gas turbine engines, particularly blades that are coupled to engine hubs using axial dovetails, are subjected to substantial stresses caused by radially-outwardly directed forces imposed on the blades by the rotation of the turbine rotor. Specifically, axial dovetails include one or more axially-extending tangs that are subjected to substantial, unevenly-applied radial loading during turbine operation. Accordingly, loads imposed on axial dovetails, and stresses resulting from the loads, are concentrated in specific areas along the lengths of the tangs due to a non-uniform load path defined by the loads. As such, a useful service life (also referred to as a "low cycle fatigue life") of a blade, as a whole, is influenced by the useful service life of the dovetails, specifically in areas of load concentration along fillets between dovetail tangs. An increase in service life of a turbine component yields lower costs, as that facilitates replacement of the turbine component at greater time intervals.

Accordingly, it is desirable to provide an axial dovetail construction that facilitates a reduction in loading in areas of load concentration.

BRIEF DESCRIPTION

In an aspect, a method for relieving stress on a dovetail of a turbine rotor blade in a gas turbine is provided. The method includes coupling at least one turbine rotor blade to a turbine disk for rotation about an axis, the at least one turbine rotor blade including a dovetail axially insertable into a correspondingly-shaped slot defined in the turbine disk, wherein the correspondingly-shaped slot includes an inner surface. The method also includes defining at least one tang on the dovetail that extends axially along at least a portion of the dovetail, the at least one tang including a tang length. The method also includes defining at least one stress relief surface in the at least one tang, the at least one stress relief surface extending along a central portion of the tang length, such that contact between the at least one tang and the inner surface is precluded, along at least the central portion of the tang length.

In another aspect, a system for relieving stress on a dovetail of a turbine rotor blade in a gas turbine is provided, wherein the turbine rotor blade is coupled to a turbine disk for rotation about an axis. The system includes at least one turbine rotor blade coupleable to the turbine disk. The at least one turbine rotor blade includes a dovetail axially insertable into a correspondingly-shaped slot defined in the turbine disk, wherein the correspondingly-shaped slot includes an inner surface. The system also includes at least one tang defined on the dovetail that extends axially along at least a portion of the dovetail, such that the at least one tang includes a tang length. The system also includes at least one stress relief surface defined in the at least one tang, that extends along a central portion of the tang length, such that contact between the at least one tang and the inner surface is precluded, along at least the central portion of the tang length.

In a further aspect, a turbine rotor blade for use in a gas turbine is provided. The turbine rotor blade includes a dovetail insertable parallel to an axis of the gas turbine into a correspondingly-shaped slot defined in a turbine disk, wherein the correspondingly-shaped slot includes an inner surface. The turbine rotor blade also includes at least one tang defined on the dovetail and extending axially along at least a portion of the dovetail, the at least one tang including a tang length. The turbine rotor blade also includes at least one stress relief surface defined in the at least one tang, the at least one stress relief surface extending along a central portion of the tang length, such that contact between the at least one tang and the inner surface is precluded, along at least the central portion of the tang length.

DETAILED DESCRIPTION

As used herein, the terms "axial" and "axially" refer to directions and orientations extending substantially parallel to a longitudinal axis of a gas turbine engine. Moreover, the terms "radial" and "radially" refer to directions and orientations extending substantially perpendicular to the longitudinal axis of the gas turbine engine.

Figure 1:
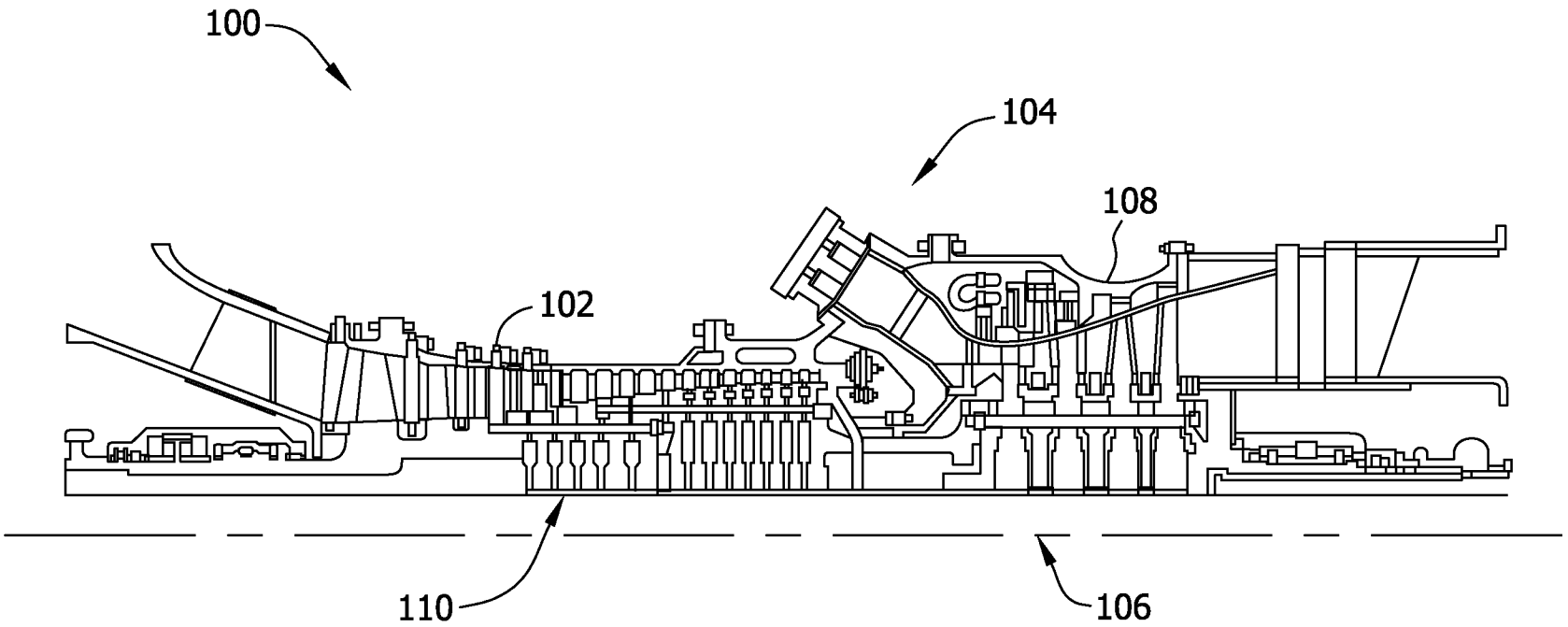
FIG. 1 is a schematic illustration of a gas turbine engine, in which an exemplary turbine rotor blade dovetail stress relief system and method may be used.

FIG. 1 is a schematic illustration of an exemplary gas turbine engine 100. Engine 100 includes a compressor assembly 102 and a combustor assembly 104. Engine 100 also includes a turbine section 108 and a common compressor/turbine rotor 110.

In operation, air flows through compressor assembly 102 such that compressed air is supplied to combustor assembly 104. Fuel is channeled to a combustion region and/or zone (not shown) that is defined within combustor assembly 104 wherein the fuel is mixed with the air and ignited. Combustion gases generated are channeled to turbine section 108 wherein gas stream thermal energy is converted to mechanical rotational energy. Turbine section 108 is coupled to rotor 110, for rotation about an axis 106.

Figure 2:
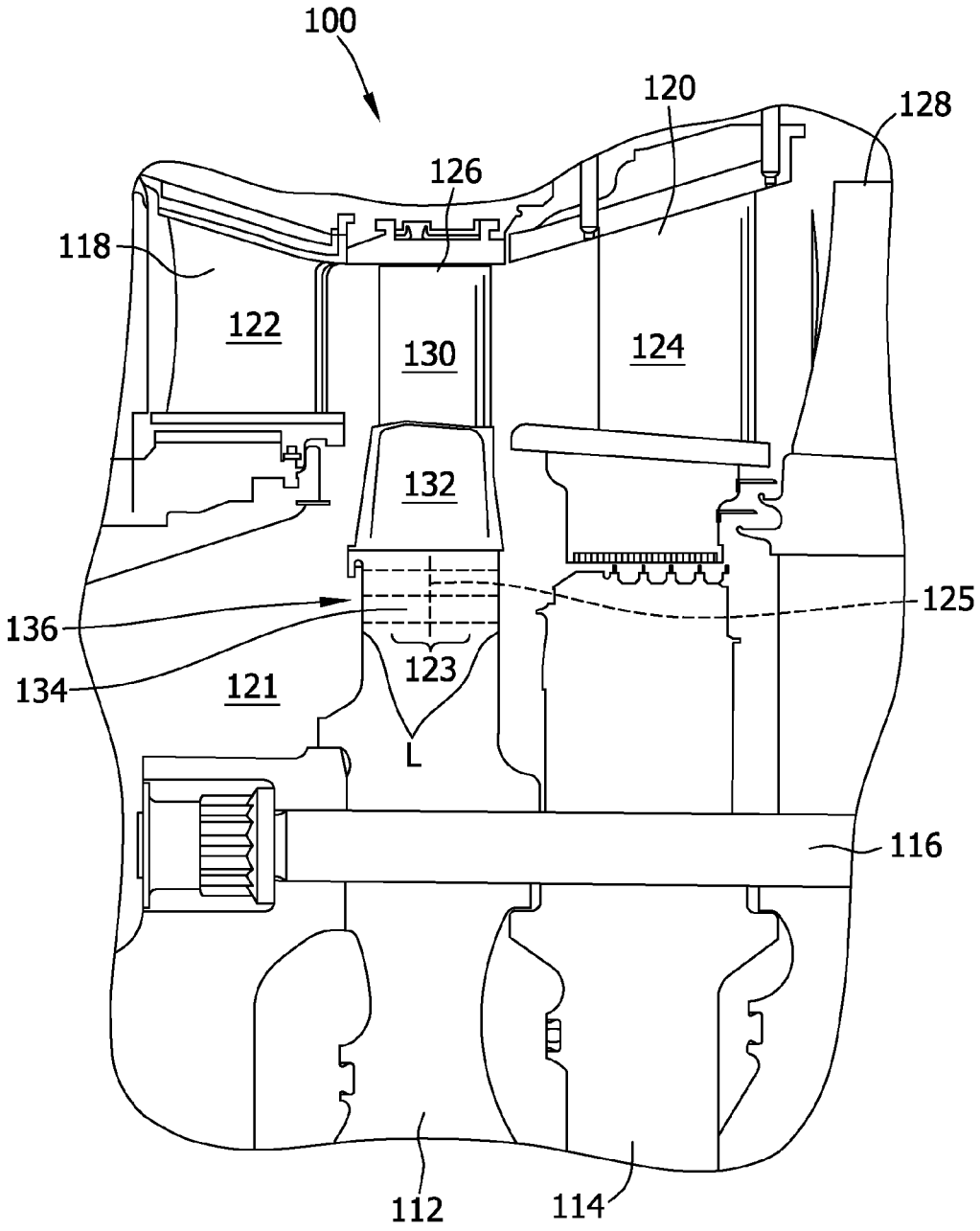
FIG. 2 is an enlarged schematic side sectional view of a portion of the gas turbine engine illustrated in FIG. 1.

FIG. 2 is an enlarged schematic illustration of a portion of gas turbine engine 100 that includes axially spaced apart rotor disks 112 and spacers 114 that are coupled to each other, for example, by a plurality of circumferentially spaced, axially extending bolts 116. Although bolts 116 are shown in FIG. 2, for facilitating coupling of disks 112 to spacers 114, any other suitable coupling structures may be used that enable gas turbine engine 100 to function as described herein. Gas turbine engine 100 includes, for example, a plurality of first-stage nozzles 118 and a plurality of second-stage nozzles 120. Each plurality of nozzles 118 and 120 includes a plurality of circumferentially spaced stator vanes, such as stator vanes 122 and 124. A plurality of first-stage rotor blades 126 are coupled, for example, via disk 112, to rotor 110 (shown in FIG. 1), for rotation between nozzles 118 and 120. In the exemplary embodiment, each rotor blade 126 includes an airfoil 130 coupled to a shank 132. Similarly, a plurality of second-stage rotor blades 128 likewise is coupled to rotor 110, for rotation between second-stage nozzles 120 and a third stage of nozzles (not shown). Although two stages of rotor blades 126 and 128, and two stages of nozzles 118 and 120, are shown and described herein, at least some known gas turbine engines include different numbers of nozzle and rotor blade stages.

Each rotor blade 126 is coupled to rotor disk 112 using any suitable coupling method that enables gas turbine engine 100 to function as described herein. Specifically, in the exemplary embodiment, each rotor blade 126 includes a dovetail 134 coupled to shank 132. Dovetail 134 is insertably received axially (i.e., in a direction parallel to axis of rotation 106 illustrated in FIG. 1) within a suitably-shaped slot 136 defined in rotor disk 112.

In at least some known gas turbine engines that include at least one rotor blade 126 coupled to an axial dovetail 134, rotation of rotor 110 imposes substantially radially-directed stress forces on at least one of axial dovetail 134 and areas of rotor disk 112 adjacent slot 136. In at least some known gas turbine engines, peak numerical values of the imposed substantially radially-directed stress forces are encountered within a generally central region 123 along a length L of axial dovetail 134, with a maximum stress force value encountered at or within a general vicinity of a midpoint 125 along length L. Accordingly, the loads imposed on dovetail 134 and adjacent areas of disk 112 is not uniformly distributed, or is said to be "unbalanced," along length L.

Figure 3:
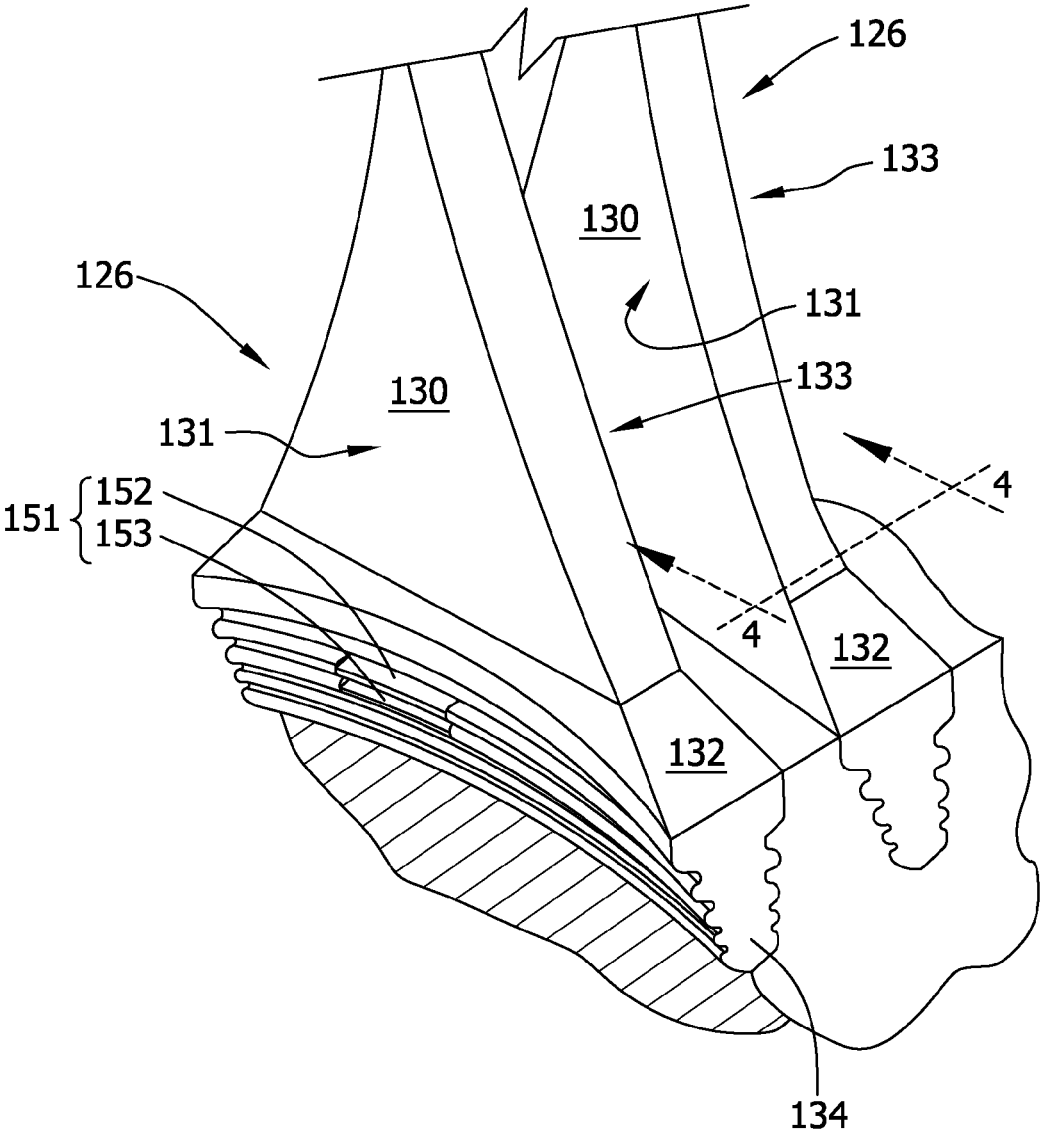
FIG. 3 is an enlarged perspective view of an exemplary turbine rotor blade dovetail stress relief system that may be used with the gas turbine engine illustrated in FIG. 1.
Figure 4:
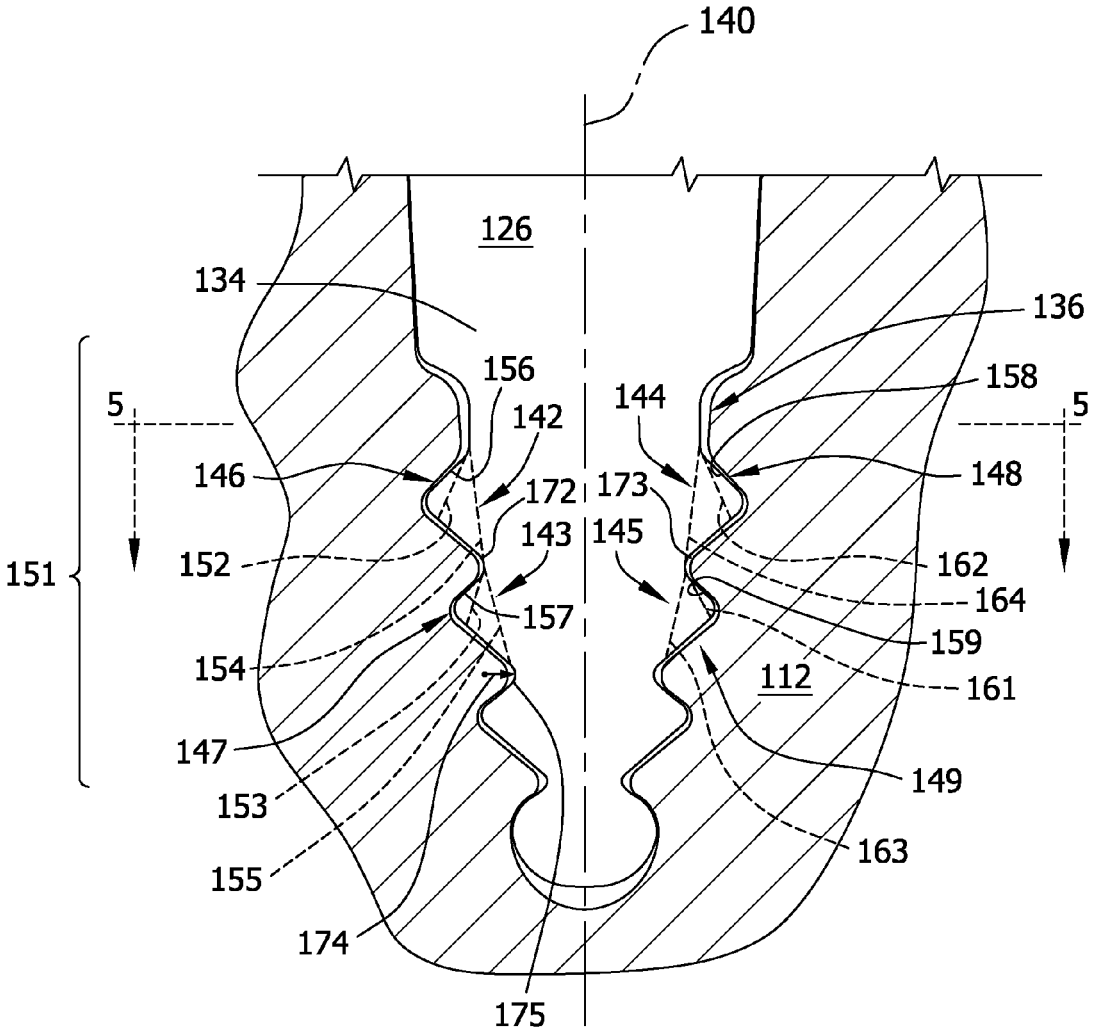
FIG. 4 is an enlarged side sectional view, taken along line 4-4 of FIG. 3, of the exemplary turbine rotor blade dovetail stress relief system that may be used with the gas turbine engine illustrated in FIG. 1.
Figure 5:
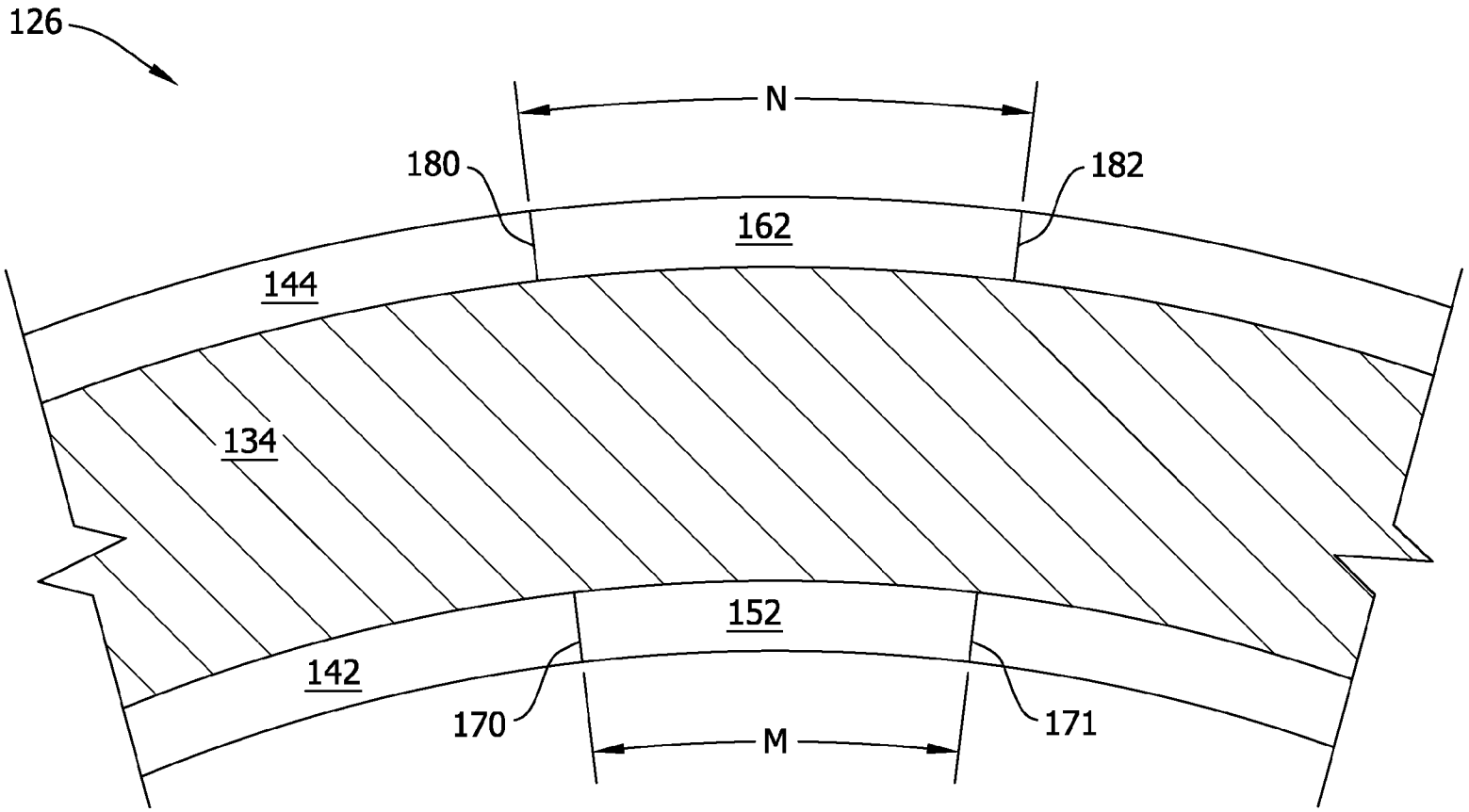
FIG. 5 is an enlarged top sectional view, taken along line 5-5 of FIG. 4, of the exemplary turbine rotor blade dovetail stress relief system that may be used with the gas turbine engine illustrated in FIG. 1.

FIGS. 3-5 illustrate an exemplary turbine rotor blade stress relief system 151. Specifically, FIG. 3 is an enlarged perspective view of an exemplary turbine rotor blade dovetail stress relief system 151 that may be used with the gas turbine engine 100 illustrated in FIG. 1, and FIG. 4 is an enlarged side sectional view, taken along line 4-4 of FIG. 3, of turbine rotor blade dovetail stress relief system 151.

Dovetail 134 of rotor blade 126 includes a plurality of axially-extending tangs 142, 143, 144 and 145 (shown in FIG. 4). Tangs 142, 143, 144, and 145 are received by axially-extending grooves 146, 147, 148, and 149, respectively, of slot 136 defined in rotor disk 112. Grooves 146, 147, 148, and 149 include upper inner surfaces 156, 157, 158, and 159, respectively. Tangs 142 and 143 extend from dovetail 134 on a pressure side 131 (shown in FIG. 3) of rotor blade 126. Tangs 144 and 145 extend from dovetail 134 on a suction side 133 (shown in FIG. 3) of rotor blade 126. Dovetail 134 also includes fillets, such as fillet 172 defined between adjacent tangs 142 and 143, and fillet 173 defined between adjacent tangs 144 and 145. Each fillet includes a radius of curvature, such as radius 174 of fillet 175. In the exemplary embodiment, dovetail 134 is bilaterally symmetrical about an axis 140. In alternative embodiments, dovetail 134 is asymmetrical with respect to axis 140.

The radially-directed stress forces described above result in compressive loads imposed on pressure faces of dovetail tangs 142-145, for example. The compressive loads are sometimes referred to as "crush loads." The radially-directed stress forces described above also result in tensile loads on fillet radii, such as radius 174, between tangs. Inasmuch as fillets, such as fillets 172, 173, or 175 are located in areas where dovetail 134 is relatively thin, e.g., in comparison to tangs 142-145, tensile loads in fillets, such as fillets 172, 173, and/or 175 are the loads which typically limit a low-cycle fatigue life of a dovetail.

Stress relief system 151 includes a stress relief surface 152 defined in tang 142 and a stress relief surface 153 defined in tang 143. In addition, a stress relief surface 162 is defined in tang 144, and a stress relief surface 161 is defined in tang 145. In the exemplary embodiment, each of stress relief surfaces 152, 153, 162, and 161 is created via removal of material from the corresponding one of tangs 142-145.

In the exemplary embodiment, tang material is removed from rotor blade 126 after the fabrication of rotor blade 126 has been otherwise completed. Removal of tang material is accomplished by any suitable removal method that enables system 151 to function as described, such as machining. In one exemplary embodiment, a wedge-shaped portion of tang material is removed along a length of one or more of tangs 142-145, leaving stress relief surfaces 152, 153, 162, and/or 161. In the exemplary embodiment, the wedge-shaped portion of removed tang material is of a constant shape and thickness along stress relief surfaces 152, 153, 162 and/or 161. Alternatively, the amount of material removed from tangs 142, 143, 144, and/or 145 varies along respective lengths of stress relief surfaces 152, 153, 162, and/or 161.

In an alternative exemplary embodiment also illustrated in FIG. 4, substantially all of the tang material is removed for at least a lengthwise portion of one or more of tangs 142-145, leaving flush surfaces 154, 155, 164, and/or 163 defined on dovetail 134. Specifically, any amount of material may be removed from one or more of tangs 142-145 that enables system 151 to function as described, such that for at least a portion of a length of one or more of tangs 142-145 (as further described herein with respect to FIG. 5), contact with a corresponding one or more of inner surfaces 156-159 is precluded.

FIG. 5 is an enlarged top sectional view, taken along line 5-5 of FIG. 4, of turbine rotor blade dovetail stress relief system 151 of turbine rotor blade 126. In the exemplary embodiment, stress relief surface 152 of tang 142 extends a distance M from a first boundary wall 170 to a second boundary wall 171. Similarly, stress relief surface 162 of tang 144 extends a distance N from a first boundary wall 180 to a second boundary wall 182. As dovetail 134 illustrated in the exemplary embodiment of FIG. 5 is curved, distances M and N represent median arc lengths along tangs 142 and 144, respectively. In the exemplary embodiment, length N of stress relief surface 162 is greater than length M of stress relief surface 152. In at least some embodiments, lengths M and N are selected such that tangs 142 and 144 are provided with substantially equal amounts of surface area remaining in contact with inner surfaces 156 and 158, respectively, such that loads on tangs 142 and 144 are substantially equalized.

In alternative embodiments, arc length M may be the same length or a greater length than arc length N. Moreover, in the exemplary embodiment, stress relief surface 152 transitions into boundary walls 170 and 171 via curved corner surfaces (not shown). By using curved transitions, reduction of localized focusing of stress forces is facilitated. Similarly, stress relief surface 162 transitions into boundary walls 180 and 182 via curved corner surfaces (not shown).

In an exemplary embodiment, stress relief surface 153 includes a length equal to M, and stress relief surface 161 includes a length equal to N. In alternative embodiments, stress relief surfaces 153 and 161 have other lengths. In general, stress relief surfaces 152, 153, 162, and 161 have any lengths suitable to enable system 151 to function as described.

In the exemplary embodiment, stress relief surfaces 152, 153, 162 and 161, extend along tangs 142-145, respectively, in areas that substantially correspond to areas of maximum stress imposed on tangs 142 and 144 during operation of engine 100. Distances M and N have any length sufficient to enable system 151 to function as desired to facilitate reduction of peak radial load stresses in rotor blade 126, by redistributing loading to other areas of tangs 142-145. Moreover, lengths of stress relief surfaces 152, 153, 162, and 161, such as lengths M and N, are determined using any suitable method that enables system 151 to function as described. A consideration in determining lengths M and N is that sufficient contact surface area on each of tangs 142-145 is maintained so that a predefined value for pressure corresponding to loads imposed on each of tangs 142-145 during operation of engine 100 is not exceeded. For example, an increase in one or both of lengths M and N may, in some embodiments, necessitate an increase in overall length L (shown in FIG. 2) of dovetail 134, which, in turn may affect other dimensions of engine 100.

As described herein, in an engine 100 having rotor blades 126 in which stress relief surfaces 152, 153, 162 and 161 are absent, during operation, tangs 142-145 physically contact inner surfaces 156-159, and transmit radial loads, creating stresses in tangs 142-145, and/or in areas of disk 112 adjacent grooves 146-149. Accordingly, stress relief surfaces 152, 153, 162, and 161, by precluding contact between tangs 142-145 and inner surfaces 156-159, facilitate preventing transmission of substantially radially-directed stress forces between tangs 142-145 and adjacent areas of dovetail 134. Moreover, stress relief surfaces 152, 153, 162, and 161 facilitate an improved balancing of radial loading ("crush load") along tangs 142-145 in dovetail 134, as well as balancing tensile loads in fillets, e.g., fillets 172, 173, and/or 175, in dovetail 134.

In the exemplary embodiment of FIGS. 3-5, stress relief surfaces 152 and 162 are defined on uppermost tangs 142 and 144, and stress relief surfaces 153 and 161 are provided on tangs 143 and 145, located below (or radially inward of) tangs 142 and 144. In alternative embodiments, stress relief surfaces are provided on any number of tangs that enable system 151 to function as desired. In addition, in alternative embodiments, stress relief surfaces are provided only on tangs on pressure side 131 or on tangs on suction side 133 of rotor blade 126, instead of on both of pressure side 131 and suction side 133, as illustrated in FIGS. 3-5.

Moreover, stress relief surfaces 152, 153, 162 and 161 facilitate introduction of cooling air into open spaces created by removal of material from tangs 142-145. In an exemplary embodiment, such cooling air is supplied via an engine inner wheelspace 121 (shown in FIG. 2) or via cooling air channels (not shown) defined within disk 112 and/or dovetail 134.

Figure 6:
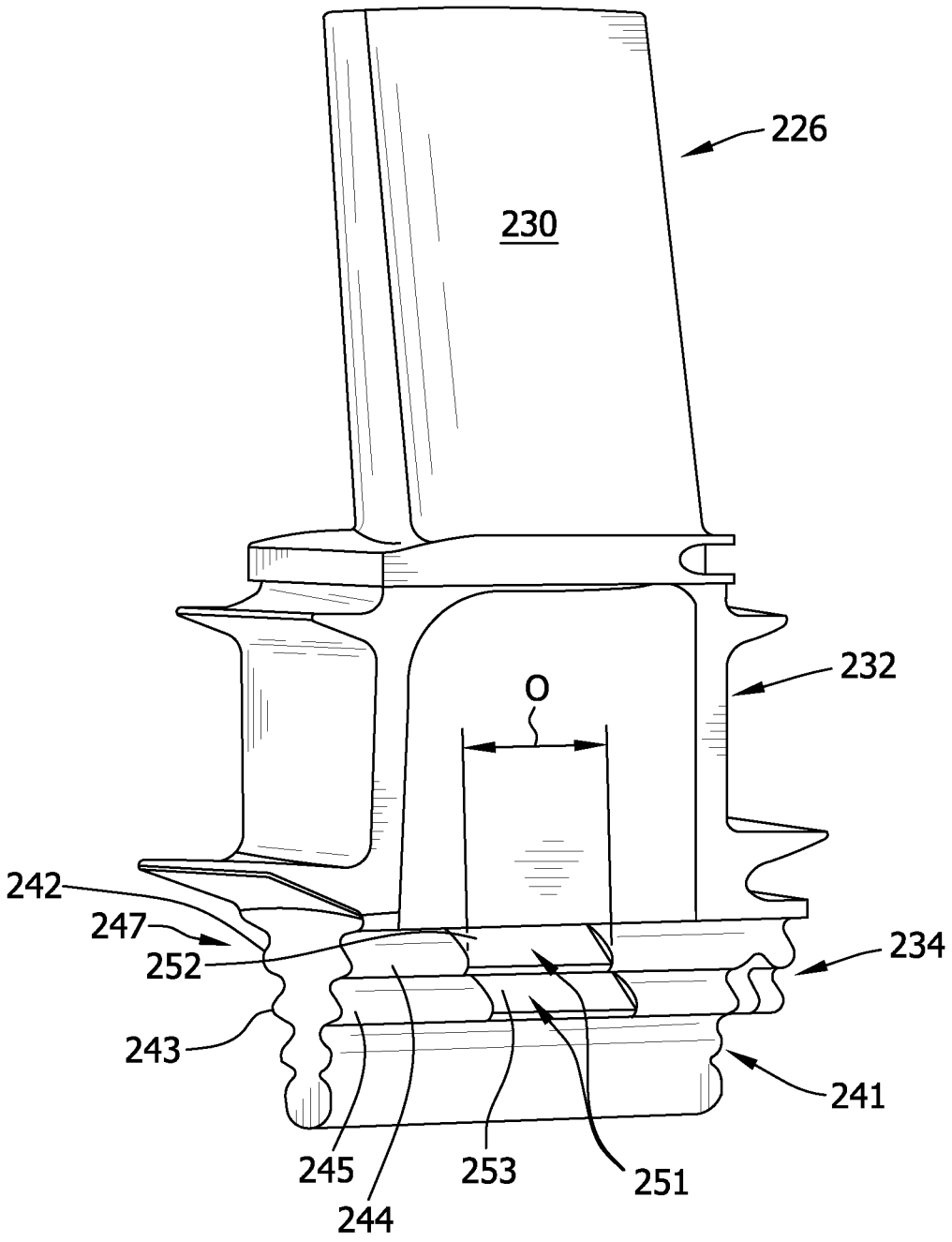
FIG. 6 is a perspective view of a turbine rotor blade, of an alternative exemplary turbine rotor blade dovetail stress relief system that may be used with the gas turbine engine illustrated in FIG. 1.

FIG. 6 is a perspective view of an alternative turbine rotor blade 226 that includes an exemplary turbine rotor blade dovetail stress relief system 251 that may be used with gas turbine engine 100 illustrated in FIG. 1. Turbine rotor blade 226 includes an airfoil 230 coupled to a shank 232. A straight axial dovetail 234 is also coupled to shank 232.

In the exemplary embodiment of FIG. 6, turbine rotor blade 226 includes at least two tangs 244 and 245, on a first side 241 of axial dovetail 234. Turbine rotor blade 226 also includes at least two tangs 242 and 243, on a second side 247 of straight axial dovetail 234. System 251 includes a stress relief surface 252 defined in tang 244 and a stress relief surface 253 defined in tang 245. In the exemplary embodiment of FIG. 6, system 251 also includes similar stress relief surfaces (not shown) defined in tangs 242 and 243. In the exemplary embodiment, each of stress relief surfaces 252 and 253 has a length O, and stress relief surfaces on tangs 242 and 243 likewise have lengths O. In an alternative embodiment, stress relief surfaces 252 and 253 and the stress relief surfaces on tangs 242 and 243 have different lengths from each other, in any combination that enables system 251 to function as described.

Aside from turbine rotor blade 226 including a straight axial dovetail 234 (as compared to curved axial dovetail 134 of turbine rotor blade 126 shown in FIGS. 2-5), system 251 is substantially similar to system 151. For example, similar considerations to those discussed with respect to system 151 regarding defining lengths M and N, and/or the amounts of material removed to define stress relief surfaces 152, 153, 162 and 161, are applicable to defining a length O and/or the amounts of material removed to define stress relief surfaces 252 and 253.

Exemplary embodiments of a turbine rotor blade stress relief system and method are described above in detail. The turbine rotor blade stress relief systems and methods are not limited to the specific embodiments described herein, but rather, components of the turbine rotor blade stress relief system and/or steps of the method can be utilized independently and separately from other components and/or steps described herein. For example, the turbine rotor blade stress relief systems and methods described herein can also be used in combination with other machines and methods, and are not limited to practice only with gas turbine engines as described herein. Rather, the exemplary embodiments can be implemented and utilized in connection with many other motor and/or turbine applications.

In contrast to known turbine rotor blade stress relief systems, the turbine rotor blade stress relief systems and methods described herein facilitate the balancing of loading along axial dovetails via the removal of material from dovetail tangs in areas in which peak load stresses are otherwise imposed on axial dovetails. In addition, the turbine rotor blade stress relief systems and methods described herein facilitate improvement in low cycle fatigue lives for rotors and enable the use of lower cost materials. The gas turbine rotor blade constructions described herein further facilitate increased blade service life, resulting in lower costs. Moreover, the gas turbine rotor blade constructions described herein facilitate the application of a better crush load balance without increasing dovetail axial length as compared to straight axial dovetails.

Although specific features of various embodiments of the methods and systems described herein may be shown in some drawings and not in others, this is for convenience only. In accordance with the principles of the disclosure, any feature of a drawing may be referenced and/or claimed in combination with any feature of any other drawing.

This written description uses examples to disclose the methods and systems described herein, including the best mode, and also to enable any person skilled in the art to practice the disclosure, including making and using any devices or systems and performing any incorporated methods. The patentable scope of the disclosure is formed by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method for relieving stress on a dovetail of a turbine rotor blade in a gas turbine, said method comprising:

coupling at least one turbine rotor blade to a turbine disk for rotation about an axis, the at least one turbine rotor blade including a dovetail extending in a radial direction and axially insertable into a correspondingly-shaped slot defined in the turbine disk, wherein the correspondingly-shaped slot includes at least one groove, the at least one groove defined by at least an axially extending, radially upper inner surface, the radially upper inner surface extending in a plane normal to the axis from a circumferentially innermost edge to a circumferentially outermost edge and defining a depth therebetween;

defining at least one tang on the dovetail that extends axially along at least a portion of the dovetail, the at least one tang including a pair of axially extending end portions shaped complementary to the at least one groove and configured to contact the radially upper inner surface during rotation of the turbine disk; and defining at least one stress relief surface in the at least one tang, the at least one stress relief surface extending axially between the end portions and recessed relative to an outer surface of the end portions, such that the at least one tang along an axial extent of the at least one stress relief surface is spaced from the radially upper inner surface along an entirety of the depth during rotation of the turbine disk.

2. A method in accordance with claim 1, said method further comprising defining the dovetail to be one of straight relative to the axis, and curved relative to the axis.

3. A method in accordance with claim 1, wherein said defining at least one tang on the dovetail comprises:

defining a first tang on a first side of the dovetail, the first tang including a first stress relief surface defined on the first tang that includes a first boundary wall and a second boundary wall, wherein a first length is defined between the first and second boundary walls; and defining a second tang on a second side of said dovetail, the second tang including a second stress relief surface defined on the second tang that includes a third boundary wall and a fourth boundary wall, wherein a second length is defined between the third and fourth boundary walls, wherein the first length is one of less than the second length, equal to the second length, and greater than the second length.

4. A method in accordance with claim 1, wherein said defining at least one tang on the dovetail comprises:

defining a first tang on a first side of the dovetail at a first radial distance from the axis, the first tang including a first stress relief surface defined on the first tang that includes a first boundary wall and a second boundary wall, wherein a first length is defined between the first and second boundary walls; and defining a second tang on the first side of the dovetail at a second radial distance from the axis, the second tang including a second stress relief surface defined on the second tang that includes a third boundary wall and a fourth boundary wall, wherein a second length is defined between the third and fourth boundary walls, wherein the first length is one of less than the second length, equal to the second length, and greater than the second length.

5. A method in accordance with claim 1, said method further comprising removing a substantially wedge-shaped portion of the at least one tang along at least a portion of a length of the at least one tang.

6. A method in accordance with claim 1, said method further comprising removing substantially all of the at least one tang along at least a portion of a length of the at least one tang.

7. A method in accordance with claim 1, said method further comprising removing a portion of the at least one tang along at least a portion of a length of the at least one tang, such that the removed portion of the at least one tang has a constant cross-section.

8. A system comprising:

at least one turbine rotor blade coupleable to a turbine disk for rotation about an axis, said at least one turbine rotor blade including a dovetail extending in a radial direction and axially insertable into a correspondingly-shaped slot defined in said turbine disk, said slot comprising at least one groove, said at least one groove defined by at least an axially extending, radially upper inner surface, said radially upper inner surface extending in a plane normal to the axis from a circumferentially innermost edge to a circumferentially outermost edge and defining a depth therebetween, said dovetail comprising at least one tang extending axially along at least a portion of said dovetail, said at least one tang comprising:

a pair of axially extending end portions shaped complementary to said at least one groove and configured to contact said radially upper inner surface during rotation of said turbine disk; and at least one stress relief surface extending axially between said end portions and recessed relative to an outer surface of said end portions, such that said at least one tang along an axial extent of said at least one stress relief surface is spaced from said radially upper inner surface along an entirety of said depth during rotation of said turbine disk.

9. A system in accordance with claim 8, wherein said dovetail is straight relative to the axis.

10. A system in accordance with claim 8, wherein said dovetail further comprises:

a first tang defined on a first side of said dovetail, said first tang including a first stress relief surface that includes a first boundary wall and a second boundary wall each respectively defined in said axially extending end portions, to define a first length between said first and second boundary walls; and a second tang defined on a second side of said dovetail, said second tang including a second stress relief surface that includes a third boundary wall and a fourth boundary wall each respectively defined in said axially extending end portions, to define a second length between said third and fourth boundary walls, wherein the first length is one of less than the second length, equal to the second length, and greater than the second length.

11. A system in accordance with claim 8, wherein said dovetail further comprises:

a first tang defined on a first side of said dovetail at a first radial distance from said axis, said first tang including a first stress relief surface defined on said first tang that includes a first boundary wall and a second boundary wall each respectively defined in said axially extending end portions, defining a first length between said first and second boundary walls; and a second tang defined on said first side of said dovetail at a second radial distance from said axis, said second tang including a second stress relief surface defined on said second tang that includes a third boundary wall and a fourth boundary wall each respectively defined in said axially extending end portions, defining a second length between said third and fourth boundary walls, wherein the first length is one of less than the second length, equal to the second length, and greater than the second length.

12. A system in accordance with claim 8, wherein said at least one stress relief surface is defined by removal of a substantially wedge-shaped portion of said at least one tang along at least a portion of a length of said at least one stress relief surface.

13. A system in accordance with claim 8, wherein said at least one stress relief surface is defined by removal of substantially all of said at least one tang along at least a portion of a length of said at least one stress relief surface.

14. A system in accordance with claim 8, wherein said at least one stress relief surface is defined by removal of a portion of said at least one tang along at least a portion of a length of said at least one stress relief surface, such that said removed portion of said at least one tang has a constant cross-section.

15. A system in accordance with claim 8, wherein said at least one stress relief surface is a substantially flat surface.

16. A system in accordance with claim 8, wherein said dovetail is curved relative to the axis.

17. A turbine rotor blade for use in a gas turbine, said turbine rotor blade comprising:

a dovetail extending in a radial direction and insertable parallel to an axis of the gas turbine into a correspondingly-shaped slot defined in a turbine disk, wherein the correspondingly-shaped slot includes an inner surface, the slot comprising at least one groove, the at least one groove defined by at least an axially extending, radially upper inner surface, said radially upper inner surface extending in a plane normal to the axis from a circumferentially innermost edge to a circumferentially outermost edge and defining a depth therebetween; and at least one tang extending axially along at least a portion of said dovetail, said at least one tang comprising:

a pair of axially extending end portions shaped complementary to the at least one groove and configured to contact the radially upper inner surface during rotation of the turbine disk; and at least one stress relief surface extending axially between said end portions and recessed relative to an outer surface of said end portions, such that said at least one tang along an axial extent of said at least one stress relief surface is spaced from said radially upper inner surface along an entirety of said depth during rotation of said turbine disk.

18. A turbine rotor blade in accordance with claim 17, wherein said dovetail is one of straight relative to said axis, and curved relative to said axis.

19. A turbine rotor blade in accordance with claim 17, wherein said turbine rotor blade further comprises:

a first tang defined on a first side of said dovetail, said first tang including a first stress relief surface that includes a first boundary wall and a second boundary wall each respectively defined in said axially extending end portions, to define a first length between said first and second boundary walls; and a second tang defined on a second side of said dovetail, said second tang including a second stress relief surface that includes a third boundary wall and a fourth boundary wall, to define a second length between said third and fourth boundary walls each respectively defined in said axially extending end portions, wherein the first length is one of less than the second length, equal to the second length, and greater than the second length.

20. A turbine rotor blade in accordance with claim 17, wherein said turbine rotor blade further comprises:

a first tang defined on a first side of said dovetail at a first radial distance from said axis, said first tang including a first stress relief surface defined on said first tang that includes a first boundary wall and a second boundary wall each respectively defined in said axially extending end portions, defining a first length between said first and second boundary walls; and a second tang defined on said first side of said dovetail at a second radial distance from said axis, said second tang including a second stress relief surface defined on said second tang that includes a third boundary wall and a fourth boundary wall each respectively defined in said axially extending end portions, defining a second length between said third and fourth boundary walls, wherein the first length is one of less than the second length, equal to the second length, and greater than the second length.

* * * * *